US005848440A

United States Patent [19]

Pajarola

[11] Patent Number: 5,848,440

[45] Date of Patent: Dec. 15, 1998

[54] THUMB-PROTECTIVE SPORTS GLOVE

[75] Inventor: Nando Pajarola, Davos, Switzerland

[73] Assignee: Snowlife Nando Pajarola Ag Ltd., Klosters, Switzerland

[21] Appl. No.: 910,888

[22] Filed: Aug. 13, 1997

[51] Int. Cl.[6] ..... A41D 19/00

[52] U.S. Cl. ..... 2/161.1; 2/159; 2/163

[58] Field of Search ..... 2/159, 160, 161.1, 2/163, 21, 16

[56] References Cited

U.S. PATENT DOCUMENTS

| | | | |
|---|---|---|---|
| 1,271,110 | 7/1918 | Zeigler | 2/159 |
| 2,380,633 | 7/1945 | Daiber . | |
| 2,436,755 | 2/1948 | Lapell | 2/159 |
| 3,100,302 | 8/1963 | Billings . | |
| 3,218,089 | 11/1965 | Marchand | 2/160 |
| 3,707,730 | 1/1973 | Slider | 2/161.1 |
| 3,918,097 | 11/1975 | Mlodoch | 2/161.1 |
| 4,295,229 | 10/1981 | Clark et al. . | |
| 4,438,532 | 3/1984 | Campanella et al. . | |
| 4,785,477 | 11/1988 | Marzo | 2/163 |
| 4,793,005 | 12/1988 | Hetzel, Jr. | 2/161.1 |
| 5,226,190 | 7/1993 | Lynch | 2/160 |
| 5,313,667 | 5/1994 | Levine | 2/160 |

FOREIGN PATENT DOCUMENTS

| | | |
|---|---|---|
| 0579149A1 | 1/1994 | European Pat. Off. . |
| 2543801 | 10/1984 | France . |
| 2647314 | 11/1990 | France . |
| 37 255 16A1 | 9/1988 | Germany . |
| 9303144 U | 1/1993 | Germany . |

*Primary Examiner*—Michael A. Neas
*Attorney, Agent, or Firm*—Frishauf, Holtz, Goodman, Langer & Chick, P.C.

[57] ABSTRACT

To provide, selectively, protection for the thumb of a user, especially during sporting events, such as skiing or snowboarding, or release of the thumb from the protection, the glove is formed with a strap (15) passing at least in part across the palm surface of the glove and having a loose or raised portion to define, with the palm of the hand, a loop (13) through which the thumb of the glove can be passed for protection, or withdrawal. The strap (15) is attached laterally from the root of the second or index finger of the glove on one side and, at the other side of the loop, in the region of the third and/or fourth finger of the glove. Preferably, one of the attachment members **(15*a*)** is releasable and reconnectable, for example formed by a hook and loop connection.

14 Claims, 2 Drawing Sheets

THUMB-PROTECTIVE SPORTS GLOVE

Reference to related patent, the disclosure of which is hereby incorporated by reference:

U.S. Pat. No. 4,295,229, Clark et al.

Reference to related application, the disclosure of which is hereby incorporated by reference:

U.S. Ser. No. 021,172, now U.S. Pat. No. 4,787,376, filed Mar. 3, 1987, Eisenberg (published as German DE 37 25 516 A1, Sep. 15, 1988).

Reference to related patent disclosure:

French 2,647,314, Boyer.

The present invention relates to a glove, and more particularly to a glove specifically intended for use in sports where damage to the thumb of a user might occur while engaging in the sport, particularly in winter sports.

BACKGROUND

U.S. Pat. No. 4,295,229, Clark et al., describes a padded football glove to provide protection for the wrist joint and the hand, particularly for offensive and defensive football players. The protection for the wrist and the hand of the user is provided by a padding. The padding for the wrist extends from the hand over the wrist joint; a hand pad extends from the back of the hand to the metacarpophalangeal finger joints. The finger and thumb pads are provided with individual elastic downwardly hanging finger and thumb receptacles which permit use of the fingers and the thumb. These elastic receptacles can accept not only fingers of different size, but additionally permit bending of the fingers and general use thereof. A thumb pad is provided, also having a hanging thumb receptacle. Restraining elements are provided to restrain excessive stretching of the elastic finger and thumb receptacles, formed on non-elastic material, placed around the finger receptacles and secured thereto. The elastic thumb receptacle is surrounded by a restraining band fitted on the thumb padding. The limiting or restraining band as well as the thumb padding are connected with the finger padding over upper and lower leather portions in order to prevent excessive deflection of the thumb.

This glove is conceived particularly for use in football and rugby. The protection for the thumb is permanently coupled to the thumb padding, which permanently limits the freedom of movement of the thumb, a disadvantage in many sports.

French 2,647,314, Boyer, describes a thumb protection made of plastic or metal which limits the movement of the thumb. A reinforcement element, essentially in the shape of a compressed circular ribbon or band, is extended at one end with a groove-like projection, intended to receive the thumb. The reinforcing protection element preferably is integrated into the glove. This type of thumb protection permanently limits the freedom of movement of the thumb when integrated into a glove. If the user wears the glove at the time when no sport is engaged in, the reinforcing protecting element may present an inconvenience. This disclosure also provides for the thumb protection in a form not integrated with the glove, but usable with different types of gloves. If the thumb protection is not integrated with the glove, pulling on of the thumb protection and the glove is comparatively difficult and time-consuming. Additionally, the danger of using the thumb protector, independently of the glove, is always present.

U.S. application Ser. No. 021,172, filed Mar. 3, 1987, Eisenberg (published as German DE 37 25 516 A1, Sep. 15, 1988) describes a thumb protection in form of a mitten, which can be slipped over the thumb region of a glove. The lower portion of this mitten-like case is securely connected with the glove, so that radial movement of the thumb is limited. Another embodiment illustrates a pocket element for the thumb and eyelets in the finger region of the thumb through which a ribbon or tie lace can be threaded, for subsequent attachment. This arrangement does not permit a person pulling on this glove alone, since it is not possible for the person to tie the lace after the hand is in the glove.

THE INVENTION

It is an object to provide a glove in which the thumb is protected against injury, for example during sports, and which does not interfere with the user's ability to rapidly and unassistedly pull on the glove or take it off, and which, on the one hand, provides for effective protection of luxation of the thumb while, on the other, permitting normal, effectively unimpeded movement of the thumb. Additionally, the user should have the choice of using the protection for the thumb, or not using the protection, without having to take care of any loose elements or parts.

Briefly, the protection arrangement for the glove is a strap which is passed at least in part across the palm surface of the glove. The strap is attached, at one end, in the region laterally of the root of the second finger of the glove and, in the second attachment arrangement, in the region of the palm of the glove approximately opposite the third and the fourth finger or between the third and the fourth finger. The strap forms a loose portion and, together with a part of the palm surface of the glove, a loop between the first and second attachment means or arrangements into which the thumb of the glove can be fitted when protection is desired, so that the thumb will be restrained close to the palm surface of the hand, or slipped out of the loop when free movement of the thumb is intended.

Basically, thus, the glove includes a protection for the thumb by forming, with the strap, a loop in which the thumb, can be placed so that injury can be prevented. Such a protection is particularly suitable for people performing sports, such as skiers or snowboarders who, if they should have a spill, are frequently subject to luxation of joints, and especially in the root of the thumb.

In accordance with a feature of the invention, and forming a specific advantage in accordance with the present invention, the protective arrangement for the thumb can be activated or deactivated as desired, without having to take the glove off the hand. It is only necessary to bend the thumb and slip it out of the loop formed by the strap. There is no danger that the protection for the thumb can get lost, since it is attached to the thumb, preferably releasably, at least at one end. Still, the strap is integrated with the glove. For effective protection to the thumb, it is only necessary to fit the glove thumb, with the user's thumb inside, into the loop formed by the strap and a portion of the palm of the thumb. The glove has the surprising advantage, particularly desired by snowboarders, that the thumb still has some freedom of movement although it is fitted into the strap, so that gripping movements of the hand can be carried out, for example to grip articles like sunglasses, goggles, handkerchiefs, tickets, or other small sports items. If even more freedom of use is desired, for example to carry out a specific task, the user of the glove can easily pull the thumb, and with it the thumb portion of the glove, out of the loop.

Preferably, the strap is made of a ribbon material which does not stretch, for example a nylon ribbon or tape. Alternatively, it could be elastic or somewhat elastic. An elastic ribbon increases overall comfort to the user. The loop should be so dimensioned that the angle of 60° between thumb and index finger is not exceeded. Preferably, the strap is secured laterally approximately at the side of the index finger and, further, at the palm side of the thumb approximately in the region of the fourth or ring finger. This has the advantage that, then, the thumb is aligned practically parallel to the other fingers. It can also be moved or placed relatively closely to the index finger or the third finger. Injury to the root region of the thumb, upon a spill, becomes essentially impossible. Preferably, the glove is reinforced, with a reinforcement zone, for example made of leather, in the region of attachment of the strap to the glove. This also prevents tearing off of the strap from the glove.

In accordance with a feature of the invention, one end of the strap is irremovably attached to the glove, and the other end removably, for example by a hook and loop fastener connecter also known as VELCRO, or similar releasable connection. This permits adjustment of the degree of freedom of movement of the thumb individually, and without assistance of third persons. If it is not necessary to protect the thumb, for example after sports, the strap can then be easily released from the hook and loop fastener connection, that is, without forming a loop with the palm portion of the thumb, and fitting the strap closely against the glove, providing for a neat appearance. The glove, even though it has the thumb-protective arrangement, then becomes a simple or ordinary glove, and the inactivated thumb protection feature is hardly noticeable anymore.

DRAWINGS

FIG. 1 is a highly schematic perspective view of the glove looking towards the palm portion thereof, and illustrating the thumb-protective strap and loop, the thumb not being fitted into the loop; and FIG. 2 is a schematic perspective side view of the glove from the region of the thumb, showing the thumb in position in the loop.

DETAILED DESCRIPTION

Figure 1:
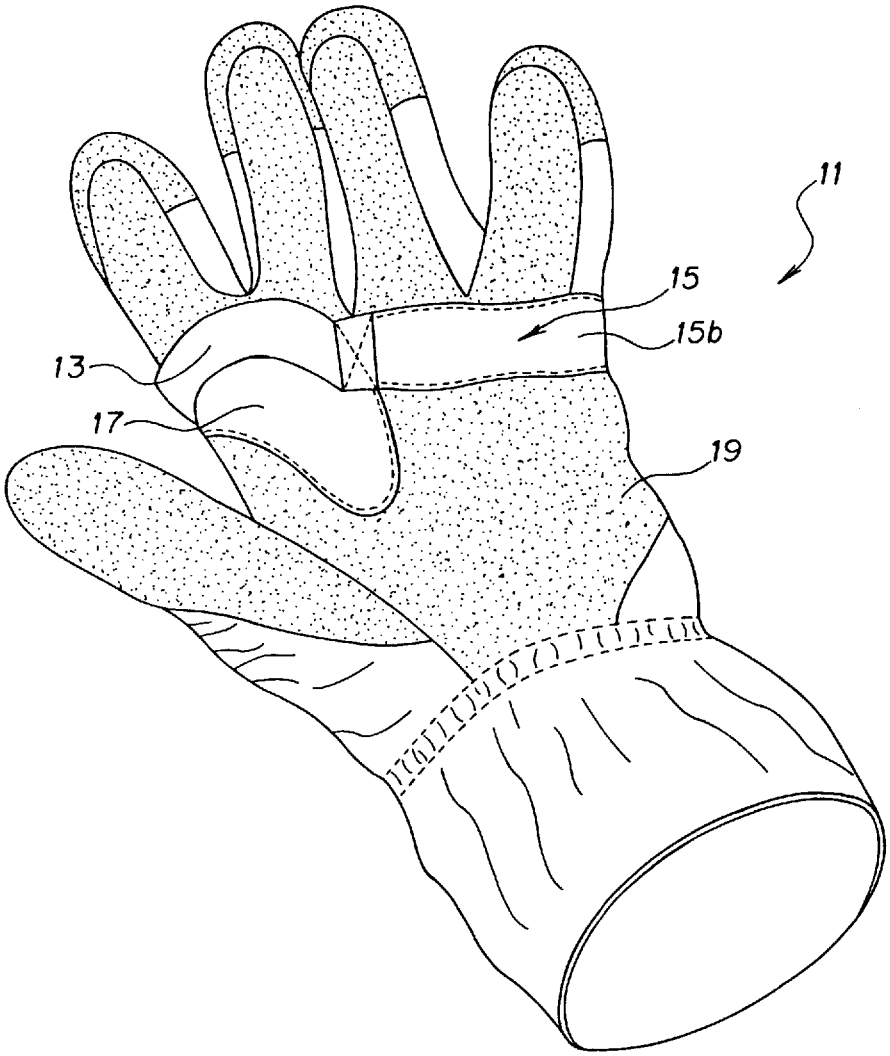
Figure 2:
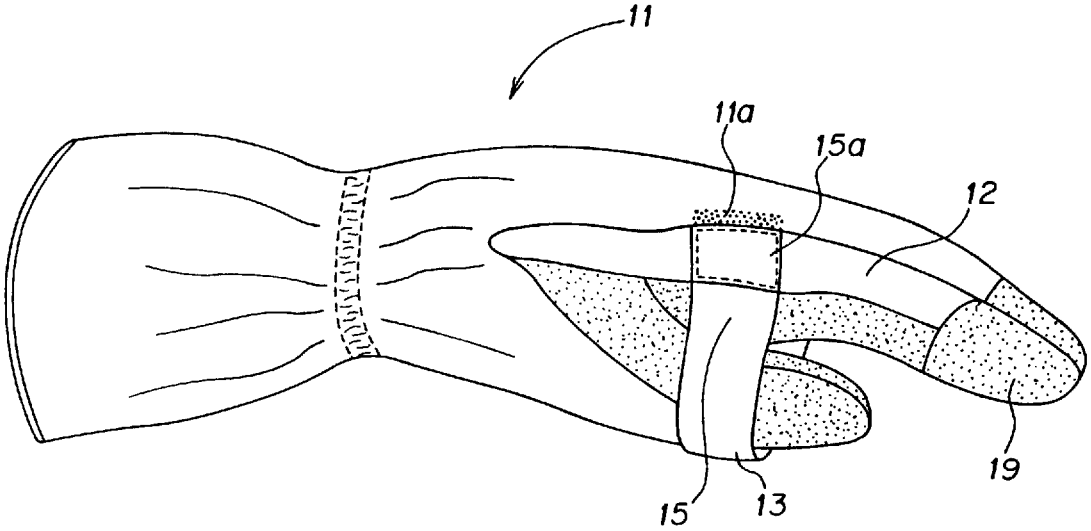

The glove 11, illustrated in FIGS. 1 and 2, is formed on the palm or inner side of the glove with a loop 13. The loop 13 is formed by a strap 15 which is secured at the side wall or side surface region 12 next to the index finger of the glove, and preferably close to the root region of the index finger, as well as being secured to the palm region of the glove. Strap 15 is secured roughly in the middle of the glove, approximately in the region of the juncture between the third and fourth finger, or geneally beneath the third and fourth finger, see FIG. 1. The loop, thus, is approximately in the region where the base joint of the index finger and the third finger are positioned when a hand is fitted into the glove. The loop 13 is so dimensioned that the gloved thumb can be easily fitted into the loop 13, and again pulled out. The 13 loop should be slightly larger than the thumb of the glove, when in use, so that there is some play or freedom of movement when the glove thumb, with the user's thumb inside, is placed into the loop 13. Yet, abduction of the user's thumb, which may occur for example in a spill during skiing or snowboarding, is effectively prevented by the loop 13.

The strap 15 can be formed as an elastic strap, a non-elastic strap, or a just slightly stretchable elastic strap. Preferably, it is attached laterally behind the index finger and approximately in the center of the glove by seams. In the example shown, the strap 15 extends over the entire center palm portion of the glove. In the region of the palm where the strap 15 is secured to the glove, a reinforcement zone 17, made for example of leather, is provided to additionally ensure against tearing off of the strap 15 when overstressed.

The glove, preferably, has a highly tear-resistant outer material, coated at the palm-side surfaces of the glove with a water-tight or water-repellent material 19. The coating, preferably, has a rough surface as shown by the stippling in FIG. 1 to ensure good gripping by the glove.

In accordance with a feature of the invention, the strap 15 forming the loop 13 can be irremovably secured to the glove 11 at only one side. FIG. 2 illustrates a hook and loop fastener connection 15*a* connecting the strap 15 to the glove 13. The glove portion of the hook and loop fastener connection is shown at 11*a*. Of course, the connection can be reversed so that the end of the strap 15 forming the loop 13 adjacent the index finger is seamed and the hook and loop fastener connection is at the portion 15*b* of the strap extending across the palm of the glove 11.

If the strap 15 is to be elastic, freedom of movement of the thumb is somewhat increased. Use of strap 15 which is seamed to the glove 11 at only one end portion, that is, irremovably securing the strap 15 at only one end portion, permits placing the strap around the thumb to form the loop 13 when protection for the thumb is desired and, at other times, placing the strap 15 against the surface of the glove, without forming a loop when the end of the strap 15 is released. A hook and loop fastener connection is preferably used to attach the non-seamed end. Making one end portion of the strap 15 releasable and reconnectable, preferably a by a hook and loop fastener connection, has the additional advantage that freedom of movement of the thumb can be adjusted individually by the user.

Various changes and modifications may be made within the scope of the inventive concept.

I claim:

1. Thumb-protective sports glove (11), wherein the glove defines a palm surface, a thumb finger, and four digit fingers, said sports glove having a protection means for the thumb of the user, wherein, in accordance with the invention, the protection means comprises a strap (15) passing at least in part transversely across the palm surface of the glove; and first attachment means (15*a*) for attaching the strap (15) at the side (12) of the glove in the region of the root of the index finger of the glove and second attachment means (15*b*) for attaching the strap (15) located in the region approximately opposite the root of the fourth finger of the glove, said strap (15), together with a portion of the palm surface of the glove, forming a loop (13) between said first and second attachment means and defining a loose portion of the strap through which the glove thumb can be inserted when protection is required, and from which the glove thumb can be retracted when desired by a user.

2. The glove of claim 1, wherein said strap (15) comprises effectively non-stretchable ribbon or tape material.

3. The glove of claim 1, wherein said strap (15) comprises elastic ribbon or tape material.

4. The glove of claim 1, further including reinforcing material (17) located in the region of at least one of said attachment means.

5. The glove of claim 4, wherein said reinforcing material comprises a leather pad.

6. The glove of claim 1, wherein one of said attachment means is releasable to provide for said strap (15) being releasably attached at one end to the glove (12), and, at the other end, irremovably attached to the glove.

7. The glove of claim 6, wherein the releasable attachment means of said one end comprises a hook and loop fastener connection.

8. The glove of claim 1, wherein said strap (15) extends from said second attachment means **(15*b*)** across the remainder of the palm surface of the glove beyond the second attachment means.

9. The glove of claim 1, wherein at least one of said **(15*a*, 15*b*)** attachment means comprises a seam attachment.

10. The glove of claim 1, wherein one of said attachment means **(15*b*) comprises an effectively irremovable seam connection, and the other of said attachment means (15*a*)** comprises a releasably and reconnectable hook and loop fastener connection.

11. Thumb-protective sports glove (11), wherein the glove defines a palm surface, a thumb finger, and four digit fingers, said sports glove having a protection means for the thumb of the user, wherein, in accordance with the invention, the protection means comprises a strap (15) passing at least in part transversely across the palm surface of the glove;

first attachment means **(15*a*) for attaching the strap (15) in a region lateral from the root of the second finger of the glove and second attachment means (15*b*) for attaching the strap (15) in the region of the third to the fourth finger of the glove, said strap (15), together with a portion of the palm surface of the glove, forming a loop (13) between said first and second attachment means and defining a loose portion of the strap through which the glove thumb can be inserted when protection is required, and from which the glove thumb can be retracted when desired by a user; and wherein said strap (15) extends from said second attachment means (15*b*)** across the remainder of the palm surface of the glove beyond the second attachment means.

12. The glove of claim 11, wherein one of said attachment means is releasable to provide for said strap (15) being releasably attached at one end to the glove and at the other end, irremovably attached to the glove.

13. The glove of claim 12, wherein said releasable attachment means comprises a hook and loop fastener connection.

14. Thumb-protective sports glove (11), wherein the glove defines a palm surface, a thumb finger, and four digit fingers, said sports glove having a protection means for the thumb of the user, wherein, in accordance with the invention, the protection means comprises a strap (15) passing at least in part transversely across the palm surface of the glove;

first attachment means **(15*a*) for attaching the strap (15) in a region lateral from the root of the second finger of the glove and second attachment means (15*b*) for attaching the strap (15) in the region of the third to the fourth finger of the glove, said strap (15), together with a portion of the palm surface of the glove, forming a loop (13) between said first and second attachment means and defining a loose portion of the strap through which the glove thumb can be inserted when protection is required, and from which the glove thumb can be retracted when desired by a user; and wherein one of said attachment means (15*b*) comprises an effectively irremovable seam connection, and the other of said attachment means (15*a*)** comprises a releasably and reconnectable hook and loop fastener connection.

* * * * *